US006289521B1

(12) United States Patent
Ikeda

(10) Patent No.: US 6,289,521 B1
(45) Date of Patent: Sep. 18, 2001

(54) HELMET CHIN COVER AND HELMET ATTACHED WITH CHIN COVER

(75) Inventor: Yoshiyuki Ikeda, Ryugasaki (JP)

(73) Assignee: Shoei Co., Ltd., Tokyo (JP)

( * ) Notice: Subject to any disclaimer, the term of this patent is extended or adjusted under 35 U.S.C. 154(b) by 0 days.

(21) Appl. No.: 09/650,549

(22) Filed: Aug. 30, 2000

(51) Int. Cl.[7] ..... A42B 7/00
(52) U.S. Cl. ..... 2/421; 2/424
(58) Field of Search ..... 2/421, 424, 425

(56) References Cited

U.S. PATENT DOCUMENTS 4,538,303 * 9/1985 Schnitzler ..... 2/424
5,095,550 * 3/1992 Perlinger ..... 2/422
5,619,755 * 4/1997 Casartelli ..... 2/424

FOREIGN PATENT DOCUMENTS

3526646 * 9/1986 (DE) .
321875 * 6/1989 (EP) .
1526574 * 9/1978 (GB) .
2048056 * 12/1980 (GB) .

* cited by examiner

*Primary Examiner*—Rodney M. Lindsey
(74) *Attorney, Agent, or Firm*—Jones,Day, Reavis & Pogue

(57) ABSTRACT

A helmet chin cover includes a shape retaining member having an attached portion which can be attached to a helmet, and a wind shield portion capable of preventing a driving wind from abutting against a portion near a chin of a helmet wearer when the attached portion is attached to the helmet. The said wind shield portion has at least one ventilation hole. This helmet chin cover is capable of performing ventilation near the chin of the helmet wearer well. Also, this helmet chin cover is capable of preventing a wind generated by driving, which abuts against the chest of the helmet wearer and is directed toward the chin, from being dragged between the lower end of chin cover portion of the helmet and the chin of the helmet wearer to produce a whistling sound.

27 Claims, 9 Drawing Sheets

HELMET CHIN COVER AND HELMET ATTACHED WITH CHIN COVER

TECHNICAL FIELD

The present invention relates to a chin cover to be attached to a helmet in order to cover the chin of a helmet wearer, and a helmet attached with this chin cover.

BACKGROUND OF THE INVENTION

A helmet chin cover as described above is described in, e.g., Japanese Utility Model Publication No. 5-16180. The chin cover described in this reference is comprised of a plate-like attached member serving as an elastic shape retaining member, and a flexible cover member attached to this attached member. When the chin cover is attached to a full-face-type helmet, the upper half of the attached member is interposed between the lower rib member of an outer shell and the impact-on-the-chin-and-cheek absorbing liner, and the lower half thereof is arranged substantially along the lower end face of the impact-on-the-chin-and-cheek absorbing liner. Hence, the flexible cover member is arranged to cover the chin of the helmet wearer from its lower front to a portion below it.

In this state, when the helmet wearer drives the motorcycle, the wind generated by driving which abuts against the chest of the helmet wearer and directed to his chin is blocked by the flexible cover member. Thus, the wind generated by driving is prevented from being dragged between the lower end of the chin cover portion of the helmet and the chin of the helmet wearer to produce a whistling sound.

When this chin cover is attached to a full-face-type helmet, ventilation near the chin of the helmet wearer is not performed well.

SUMMARY OF THE INVENTION

The present invention is directed to effectively correcting the above drawbacks of the helmet chin cover described above with a comparatively simple structure.

It is, therefore, the main object of the present invention to provide a helmet chin cover capable of performing ventilation near the chin of the helmet wearer well.

It is another object of the present invention to provide a helmet chin cover capable of preventing a wind generated by driving, which abuts against the chest of the helmet wearer and is directed toward the chin, from being dragged between the lower end of chin cover portion of the helmet and the chin of the helmet wearer to produce a whistling sound.

According to an aspect of the present invention, there is provided a helmet chin cover comprising a shape retaining member having an attached portion which can be attached to a helmet, and a wind shield portion capable of preventing a driving wind from abutting against a portion near a chin of a helmet wearer when the attached portion is attached to the helmet, the wind shield having at least one ventilation hole. According to another aspect of the present invention, there is provided a helmet attached with this chin cover.

The above and other objects, features and advantages of this invention will become readily apparent from the following detailed description thereof which is to be read in connection with the accompanying drawings.

DETAILED DESCRIPTION OF THE INVENTION

A chin cover according to an embodiment of the present invention and a full-face-type helmet attached with this chin cover will be described with reference to the accompanying drawings.

(1) Description on Chin Cover

Figure 1:
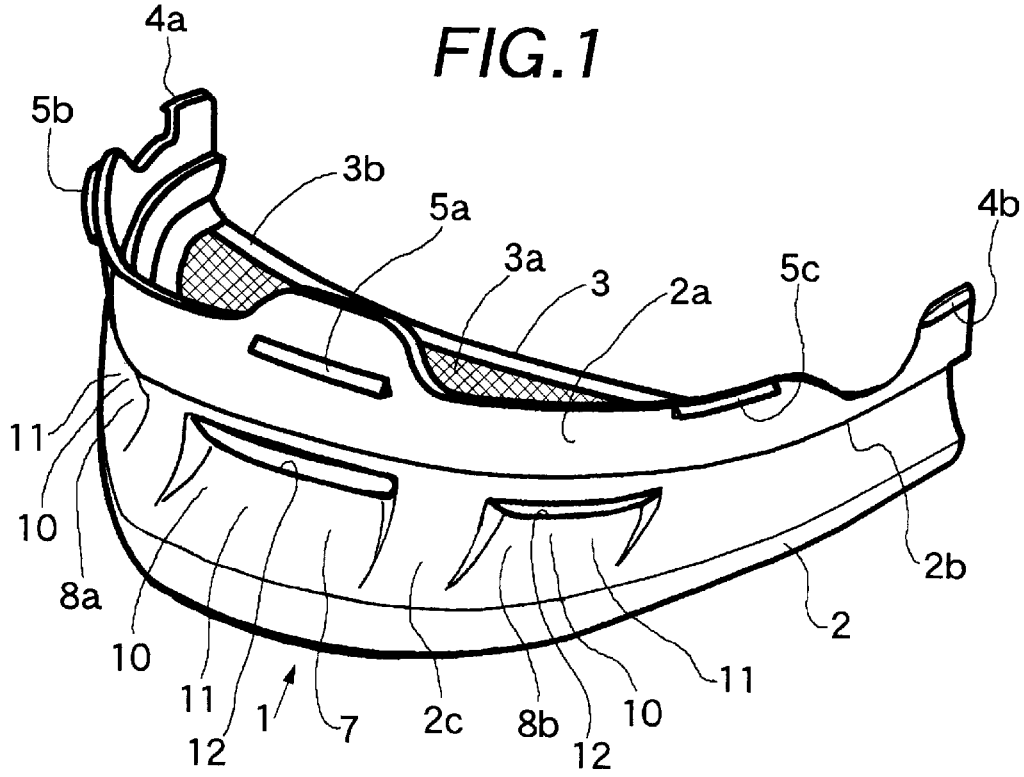
FIG. 1 is a perspective view, seen from obliquely above, of a chin cover according to an embodiment of the present invention.
Figure 3:
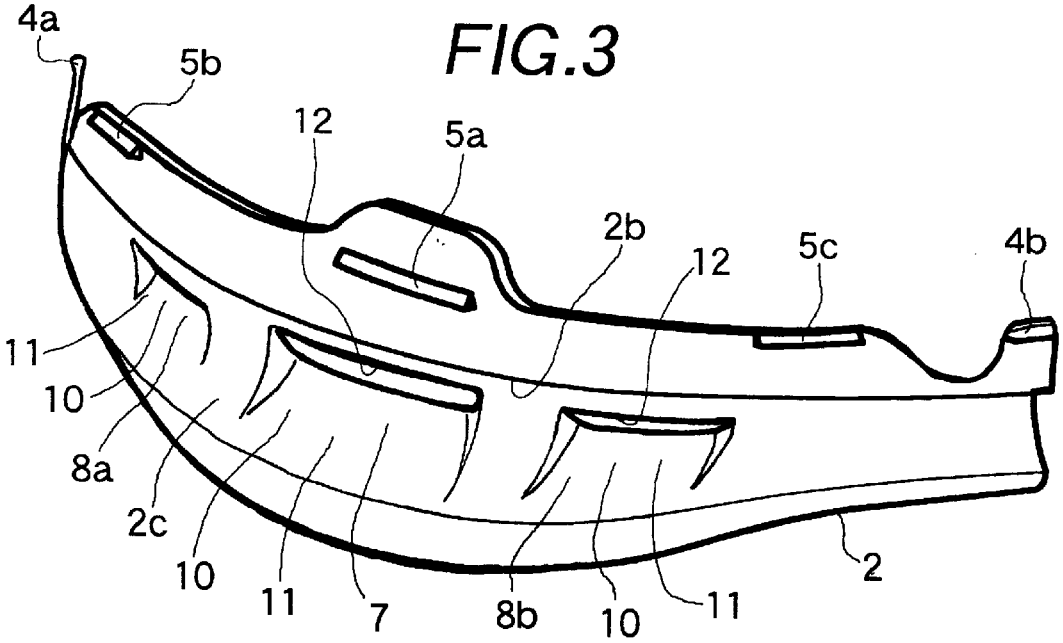
FIG. 3 is a perspective view, seen from obliquely above, of a shape retaining member used in the chin cover shown in FIG. 1.
Figure 2:
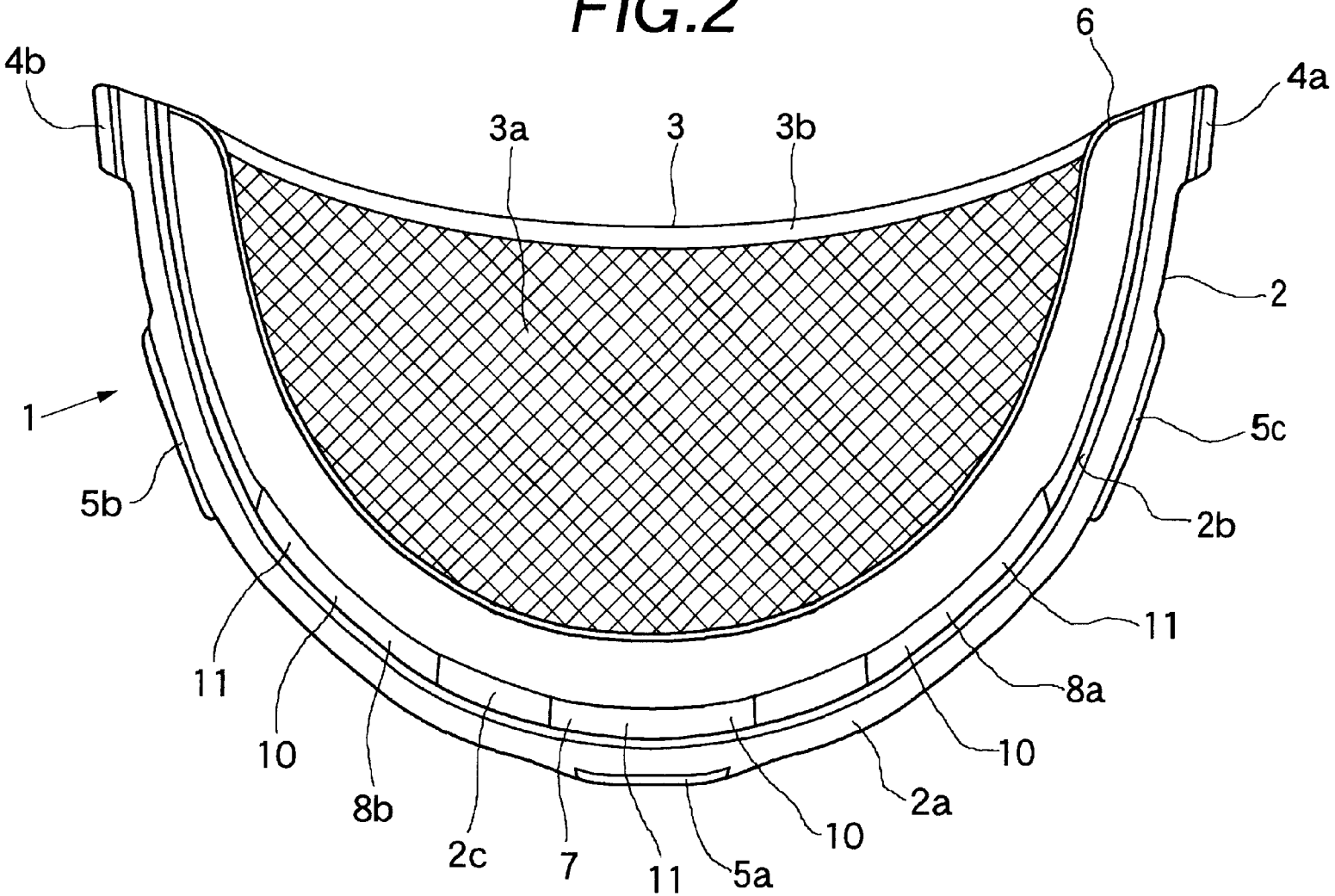
FIG. 2 is a bottom view of the chin cover shown in FIG.1.
Figure 4:
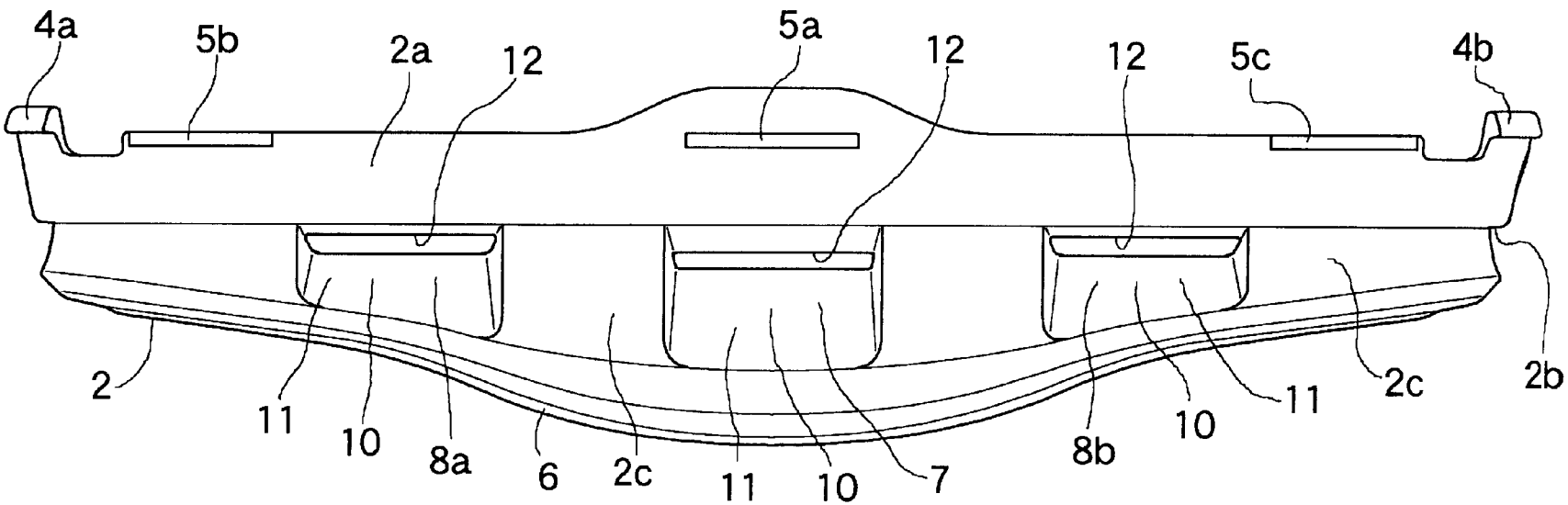
FIG. 4 is a front view of the shape retaining member shown in FIG. 3.
Figure 5:
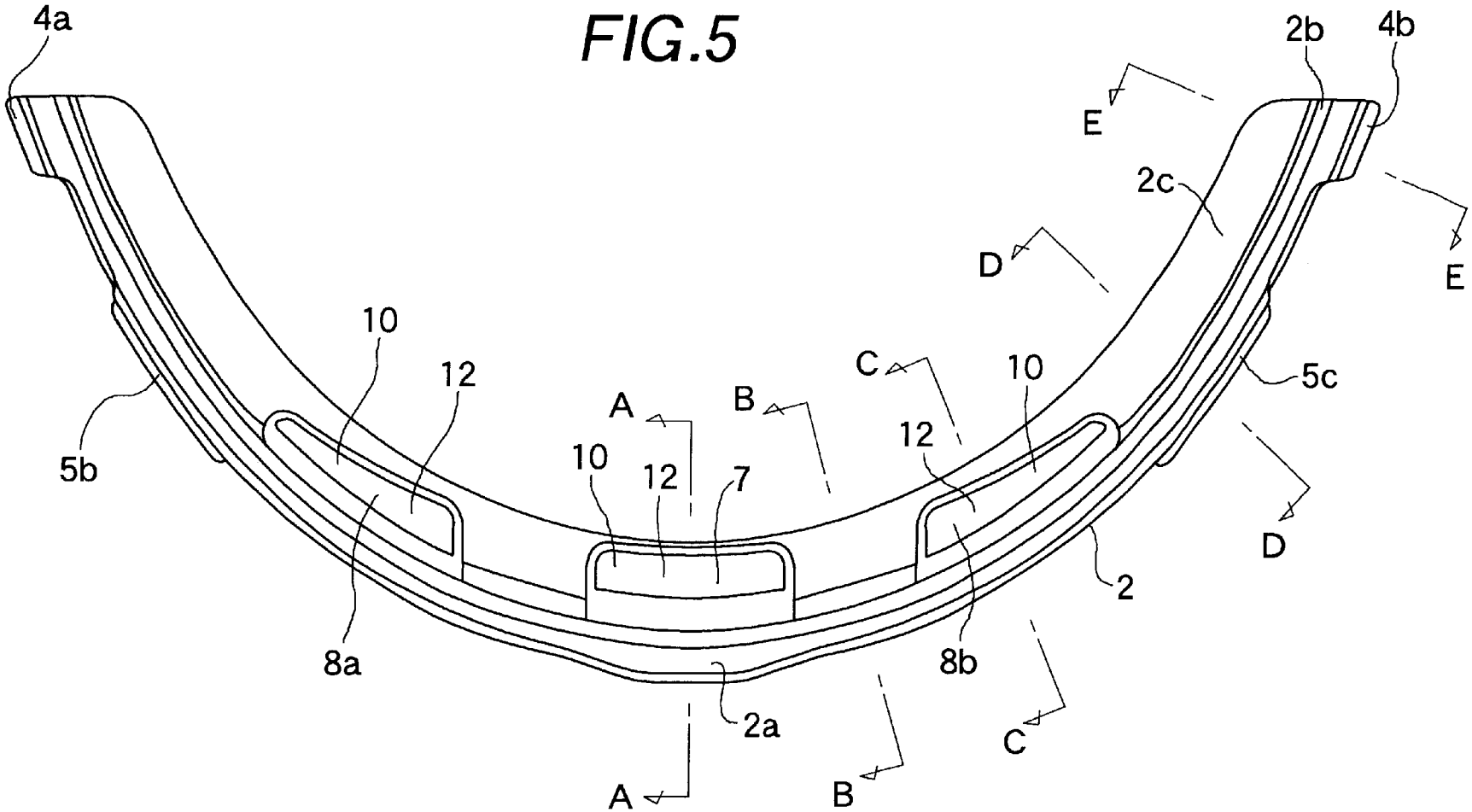
FIG. 5 is a plan view of the shape retaining member shown in FIG. 3.

As shown in FIGS. 1 and 2, a chin cover 1 is comprised of a substantially plate-like elastic shape retaining member 2 extending in substantially the horizontal direction to be bent in a substantially arcuate manner and upright in substantially the vertical direction with its central portion projecting forward, and a substantially crescent-shaped flexible cover member 3 attached to the elastic shape retaining member 2 to spread out backward in substantially the horizontal direction. The elastic shape retaining member 2 can be formed by monolithic molding from a synthetic resin such as soft polyethylene or other elastic material to have a predetermined shape. The flexible cover member 3 can be constituted by a substantially crescent-shaped flexible cover main body 3*a* and a flexible rim member 3*b* attached to the free end (i.e., a portion corresponding to the chord of the crescent) of the flexible cover main body 3*a* by sewing or the like to sandwich it. The flexible cover main body 3*a* can be attached to the elastic shape retaining member 2 by sewing or adhering its portion corresponding to the arc of the crescent (i.e., its portion facing its portion corresponding to the chord) to near the lower end of the elastic shape retaining member 2. A portion of the flexible cover member 3 corresponding to the chord of the crescent can also have a substantially arcuate shape bent toward its portion corresponding to the arc.

The flexible cover main body 3*a* can be made of an appropriate air permeable or nonpermeable fabric material, e.g., a high-permeable fabric such as a lace fabric (e.g., double raschel lace) obtained by lacing a lace thread such as, a nylon thread or an air nonpermeable fabric such as a synthetic leather. The flexible rim member 3*b* can be made of a tape-like flexible stretchable member obtained by covering, e.g., two rubber belts spaced apart from each other, as core members with an appropriate fabric. This tape-like member can be used after it is folded in two to sandwich the free end of the flexible cover main body 3*a*.

The elastic shape retaining member 2 maintains substantially the same shape when it is monolithically molded (see FIGS. 3 to 6) and when it is attached to a full-face-type helmet 20. When it is assembled to form the chin cover 1 (that is, to which the flexible cover member 3 is already attached but which is not yet attached to the helmet 20), as shown in FIGS. 1 and 2, the elastic shape retaining member 2 is bent in substantially the horizontal direction more largely than it is in FIGS. 3 to 6. This is due to the following reason. Since a flexible rim member 2*b* stretched to a certain degree is attached to a flexible cover main body 2*a*, the retracting force of the flexible rim member 2*b* acts on the flexible shape retaining member 2 through the flexible cover main body 2*a* as a force that increases the bend in substantially the horizontal direction.

As shown in FIGS. 3 to 6, the elastic shape retaining member 2 is constituted by the attached portion 2*a* which is formed on the upper portion of the elastic shape retaining member 2 along its longitudinal direction and which can be attached to the helmet 20, and a wind shield portion 2*c* which is continuously formed on the lower end of (i.e., under) the attached portion 2*a* through the position regulating step 2*b* and which can be disposed under a chin cover portion 21*a* of a head protecting body 21 of the helmet 20. The step 2*b* and wind shield portion 2*c* also extend to be bent in substantially the arcuate manner throughout substantially the entire length of the elastic shape retaining member 2 with their central portions projecting forward, in the same manner as the attached portion 2*a*.

As shown in FIGS. 3 to 6 and FIG. 7A, the attached portion 2*a* has a pair of right and left engaging pawls 4*a* and 4*b* at the upper ends near its right and left ends, and locking steps 5*a*, 5*b* and 5*c* near its center and at the right and left sides. A thick portion 6 is formed on the lower end of the wind shield portion 2*c* along the longitudinal direction. As if shown in FIGS. 1 and 2, the flexible cover member 3 is attached, above the thick portion 6, to near the lower end of the wind shield portion 2*c* by sewing or the like.

As shown in FIGS. 3 to 6, a central ventilation hole 7 and a pair of right and left ventilation holes 8*a* and 8*b* are formed at substantially the center and the right and left sides of the wind shield portion 2*c* to be lined substantially horizontally. Hence, a total of three ventilation holes are formed in the wind shield portion 2*c*.

Figure 7A:
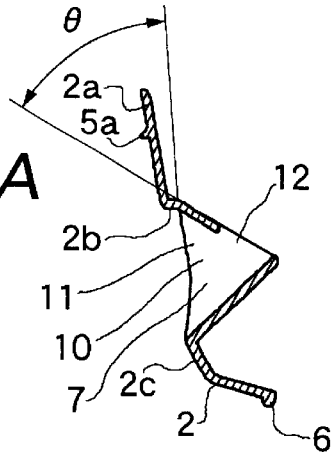
FIG. 7A is a sectional view taken along the line A—A of FIG. 5.
Figure 7B:
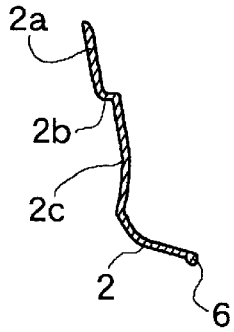
FIG. 7B is a sectional view taken along the line B—B of FIG. 5.
Figure 7C:
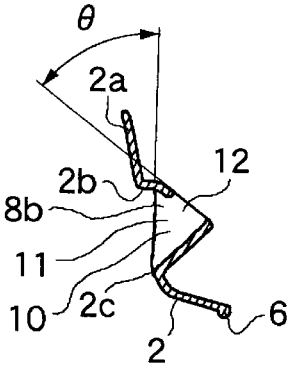
FIG. 7C is a sectional view taken along the line C—C of FIG. 5.
Figure 7D:
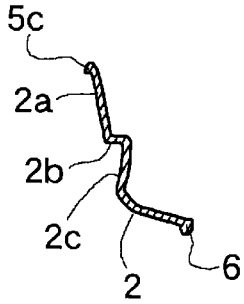
FIG. 7D is a sectional view taken along the line D—D of FIG. 5.
Figure 7E:
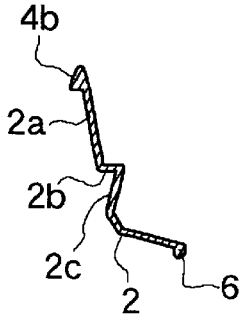
FIG. 7E is a sectional view taken along the line E—E of FIG. 5.

Each of the ventilation holes 7, 8*a* and 8*b* has a tubular projecting portion or flange portion 10 projecting backward substantially to form a frustum of cone such as a frustum of quadrangular pyramid. Each flange portion 10 has a forward opening 11 and backward opening 12, as shown in FIGS. 7A and 7C. The backward opening 12 is inclined upward at an angle of θ with respect to the forward opening 11 in order to prevent raindrops or the like from entering. This inclination angle θ is approximately 45° in the embodiment shown in FIGS. 7A and 7C but is generally preferably in the range of 25° to 70° from the viewpoint of practicality and is more preferably in the range of 35° to 60°.

Since the opening areas of the flange portions 10 of the ventilation holes 7, 8*a* and 8*b* gradually increase from their backward openings 12 toward their forward openings 11, the backward openings 12 have areas smaller than those of the corresponding forward openings 11. This aims at preventing the wind generated by driving from being guided to the rear side of the wind shield portion 2*c* of the elastic shape retaining member 2 through the ventilation holes 7, 8*a* and 8*b* as much as possible, so that a negative pressure can be easily generated on the rear side of the wind shield portion 2*c*. The area ratio of the forward opening 11 to the backward opening 12 of each of the ventilation holes 7, 8*a* and 8*b* is approximately 2.5 in the embodiment shown in FIGS. 7A and 7C but is generally preferably in the range of 1.5 to 4 from the viewpoint of practicality and is more preferably in the range of 2 to 3.5. In each of the ventilation holes 7, 8*a* and 8*b*, the opening area is the smallest at the backward opening 12, as shown in FIGS. 7A and 7C. The area of each backward opening 12 is approximately 1.2 $cm^2$ in the embodiment shown in FIGS. 7A and 7C but is generally preferably in the range of 0.5 $cm^2$ to 2 $cm^2$ from the viewpoint of practicality and is more preferably in the range of 0.8 $cm^2$ to 1.6 $cm^2$.

Figure 6:
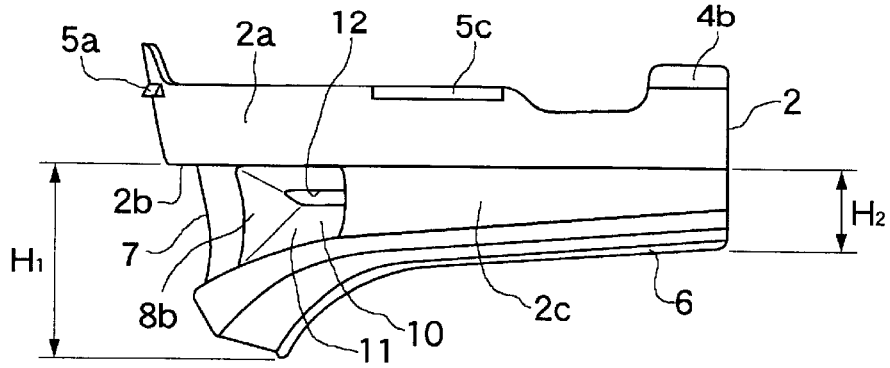
FIG. 6 is a right-side view of the shape retaining member shown in FIG. 3.

A height $H_1$ (see FIGS. 6 and 7A) of the central portion of the wind shield portion 2*c* of the elastic shape retaining member 2 is approximately 2.5 cm in the embodiment shown in FIGS. 6 and 7A but is generally preferably in the range of 1.5 cm to 3.5 cm from the viewpoint of practicality and is more preferably in the range of 2 cm to 3 cm. The height of the wind shield portion 2*c* preferably decreases gradually from its central portion toward its right and left ends. The ratio of a height $H_2$ of each of the right and left ends to the height $H_1$ of the central portion is approximately 1/2 in the embodiment shown in FIG. 6 but is generally preferably in the range of 1/4 to 3/4 from the viewpoint of practicality and is more preferably in the range of 1/3 to 2/3. The length of the wind shield portion 2*c* in the horizontal direction along its front surf ace (i.e., the length of the chord) is approximately 25 cm in the embodiment shown in FIGS. 5 and 6 but is preferably in the range of 18 cm to 32 cm from the viewpoint of practicality and is more preferably in the range of 21 cm to 29 cm.

The numerical ranges described above of the inclination angle θ of the backward opening 12 with respect to the forward opening 11 of the elastic shape retaining member 2, the area ratio of the forward opening 11 to the backward opening 12, the area of the backward opening 12, the height $H_1$ of the central portion of the wind shield portion 2*c* of the elastic shape retaining member 2, the ratio of the height $H_2$ of each of the right and left ends to the height $H_1$ of the central portion of the wind shield portion 2*c*, and the length of the wind shield portion 2*c* in the horizontal direction along its front surface substantially apply not only to the elastic shape retaining member 2 as it is monolithically molded as shown in FIGS. 3 to 7E and the elastic shape retaining member 2 which is attached to the helmet 20 after the flexible cover member 3 is attached to it, as shown in FIGS. 8 to 11, but also to the elastic shape retaining member 2 to which the flexible cover member 3 is already attached but which is not yet attached to the full-face-type helmet 20, as shown in FIGS. 1 and 2.

(2) Description on Full-Face-Type Helmet

As shown in FIGS. 8 to 11, the full-face-type helmet 20 to which the chin cover 1 is to be attached is made up of the full-face-type cap-shaped head protecting body 21 to be worn on the head of the helmet wearer 22, a shield plate 24 capable of opening/closing a window opening 23 formed in the front surface of the head protecting body 21 so as to oppose the portion of a helmet wearer 22 between the crown and a mouth 22*a* (i.e., the upper portion of the face), and a pair of right and left chin straps 25 attached inside the head protecting body 21. The shield plate 24 can be made of a transparent or translucent hard material such as polycarbonate or another type of hard synthetic resin, and can be attached to the head protecting body 21 with a pair of right and left attaching screws 26 to be vertically reciprocally pivotal. When located at the backward pivot position shown in FIGS. 8 to 11, the shield plate 24 can close the window opening 23; when at the forward pivot position where it has pivoted upward from the backward pivot position, it can open the window opening 23; and when at an intermediate position between these two positions, it can partially open the window opening 23.

Figure 8:
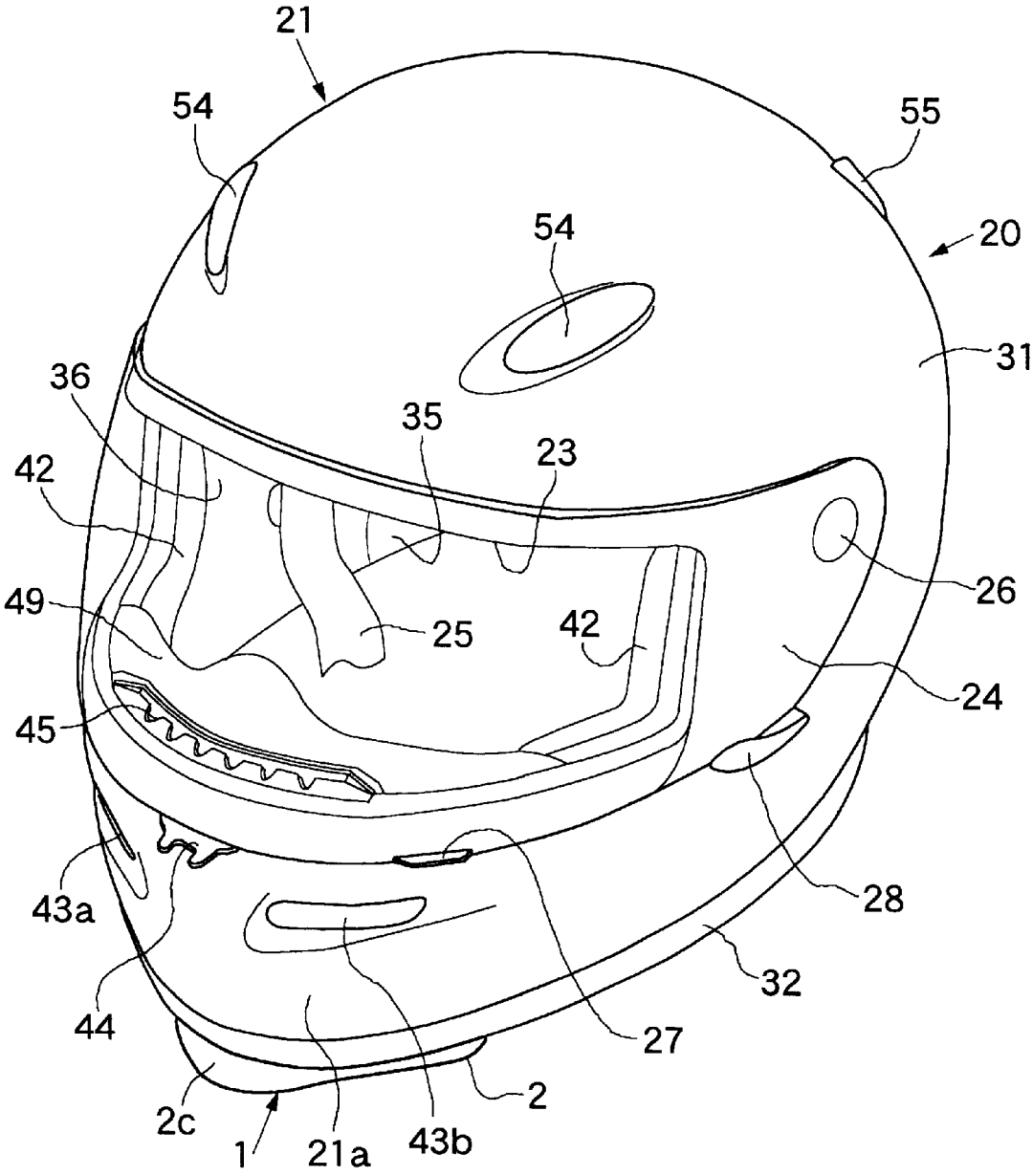
FIG. 8 is a perspective view, seen from obliquely front, of a whole full-face-type helmet attached with the chin cover shown in FIG. 1.

Referring to FIG. 8, a tap 27 is provided to the shield plate 24 such that it can be held by the helmet wearer 22 with his fingers when he reciprocally pivots the shield plate 24 upward and downward. An operating lever 28 is provided to the head protecting body 21 such that it can be operated by the helmet wearer 22 when he slightly pivots forward the shield plate 24, located at the backward pivoting position, upward.

As shown in FIGS. 8 to 11, the head protecting body 21 is made up of (i) a full-face-type outer shell 31 constituting the outer wall of the head protecting body 21, (ii) a lower rim member 32 with a substantially U-shaped section attached to the whole portion around lower end of the outer shell 31 by adhesion or the like, (iii) a window opening rim member 34 with a substantially E-shaped section attached to the whole portion around a window opening 33 formed in the outer shell 31 by adhesion or the like to form the window opening 23 of the head protecting body 21, (iv) a backing member 35 for the head attached by adhesion or the like to come into contact with the inner surface of the outer shell 31 at the forehead region, vertex region, right and left temporal regions, and occipital region respectively opposing to the forehead, crown, right and left temporals, and occiput of the helmet wearer 22, and (v) the backing member 36 for the chin and cheeks attached by adhesion or the like to come into contact with the inner surface of the outer shell 31 at the chin region and cheek regions respectively opposing a chin 22*b* and cheeks 22*c* of the helmet wearer 22.

The outer shell 31 can be made of a composite material formed by lining the inner surface of a strong shell main body made of a hard synthetic resin, e.g., FRP, or another hard material, with a flexible sheet such as a porous unwoven fabric, as is conventionally known. The lower rim member 32 can be made of a soft synthetic resin such as foamed vinyl chloride or synthetic rubber, or another soft material, as is conventionally known. The window opening rim member 34 can be made of synthetic rubber or another flexible elastic material, as is conventionally known.

Figure 9:
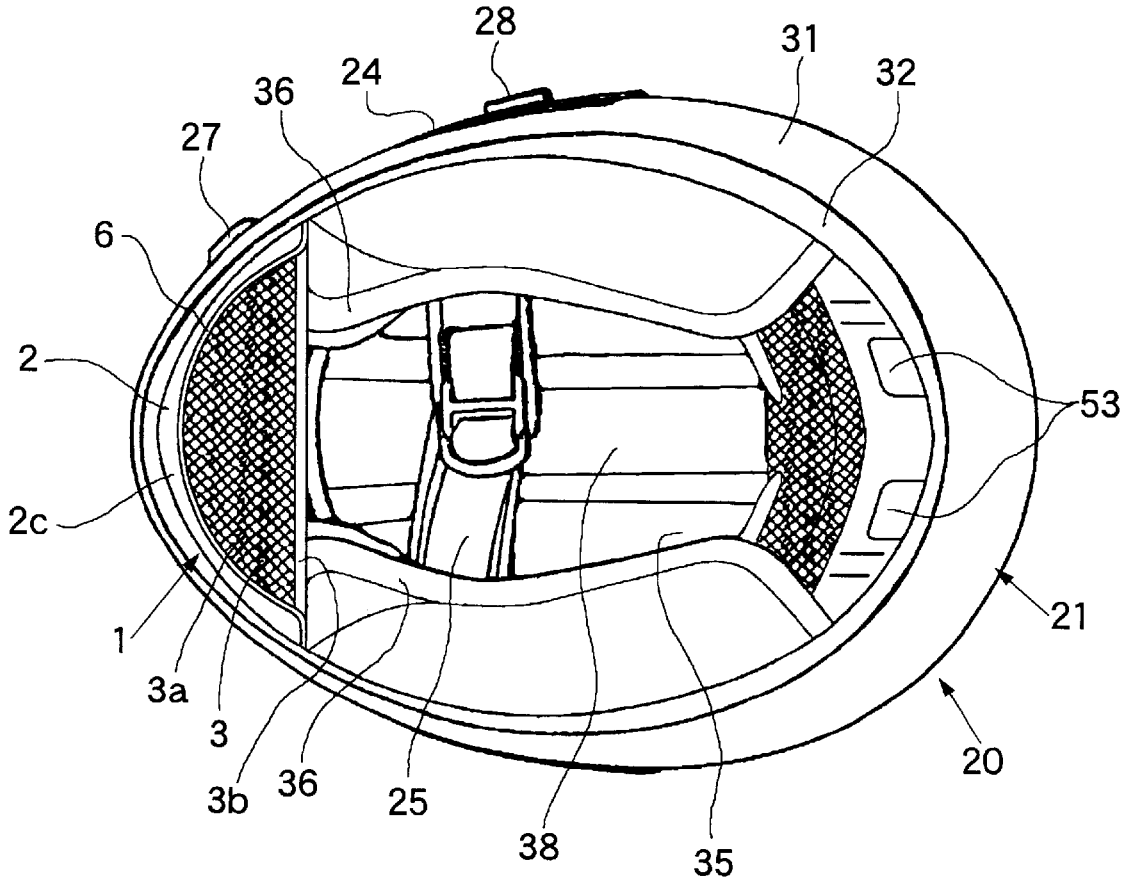
FIG. 9 is a bottom view of the full-face-type helmet shown in FIG. 8.
Figure 10:
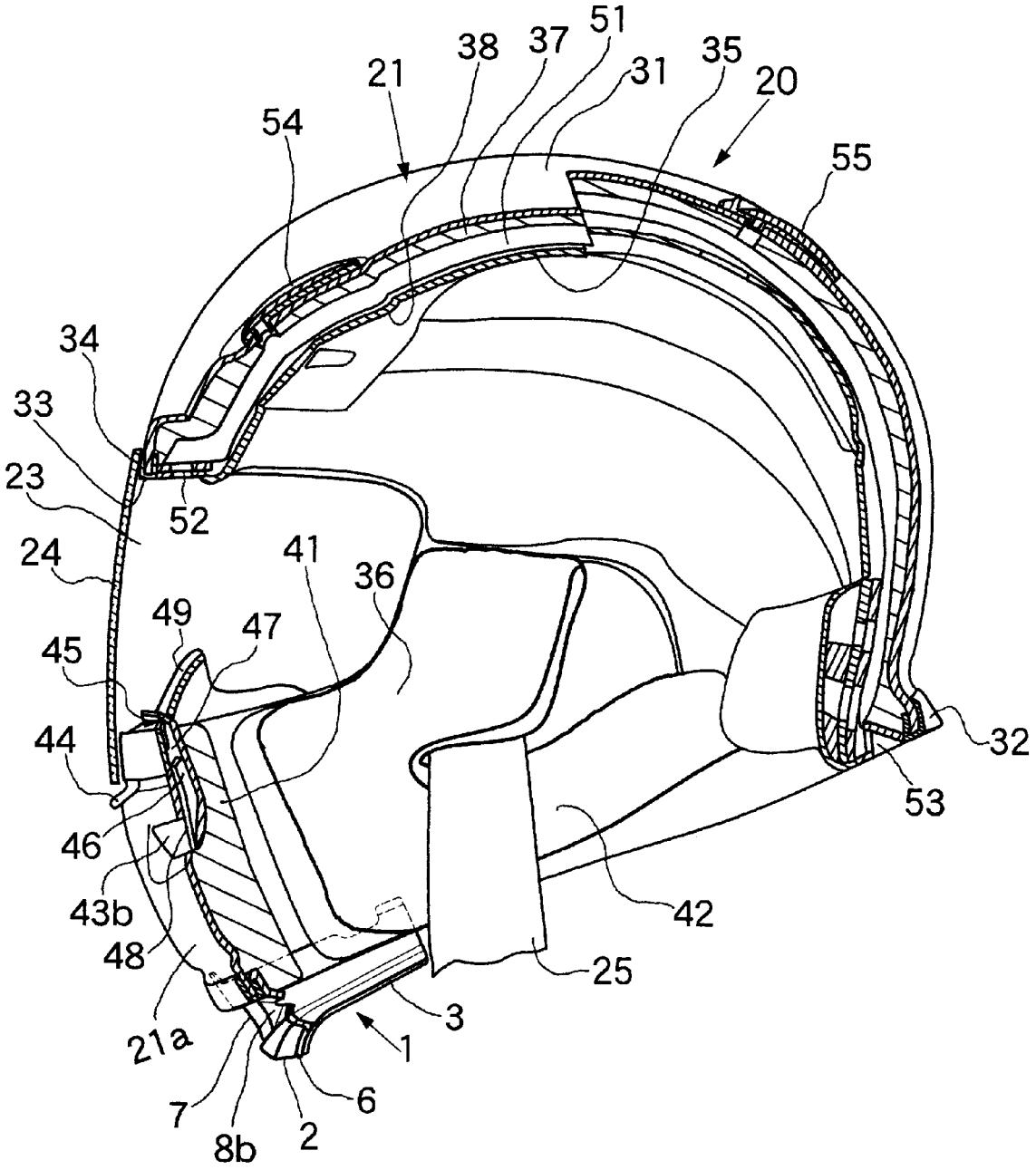
FIG. 10 is a longitudinal sectional view of the full-face-type helmet shown in FIG. 8.

As shown in FIGS. 9 and 10, the backing member 35 for the head is constituted by an impact-on-the-head absorbing liner 37 arranged in the outer shell 31, and an air permeable backing cover 38 for the head attached to the impact-on-the-head absorbing liner 37 to cover substantially its whole inner surface. The backing member 36 for the chin and cheeks is made up of an impact-on-the-chin-and-cheek absorbing liner 41 arranged in the outer shell 31, and a pair of right and left blockish inside pads 42 attached to come into contact with the inner surface of the impact-on-the-chin-and-cheek absorbing liner 41 at the right and left cheek regions opposing the right and left cheeks 22*c* of the helmet wearer 22.

The impact-on-the-head absorbing liner 37 and impact-on-the-chin-and-cheek absorbing liner 41 can be made of a synthetic resin such as foamed polystyrene or another material with appropriate rigidity and plasticity, as is conventionally known. The backing cover 38 for the head can be made of a combination of a woven fabric and a porous unwoven fabric formed by laminating layers, each having an appropriate shape and consisting of a synthetic resin such as urethane foam or another elastic material with high flexibility, on its one (i.e., the outer surface) surface opposing the impact-on-the-head absorbing liner 37 or two surfaces, as is conventionally known. Each blockish inside pad 42 for the cheeks can be made of a thick plate-like cushion member made of a synthetic resin such as urethane foam or another elastic material with high flexibility, and a bag-like member covering the cushion member to form a bag, as is conventionally known.

Referring to FIG. 8, a pair of right and left intake/exhaust holes 43*a* and 43*b* are formed in the chin region of the outer shell 31 (i.e., a region opposing the chin 22*b* of the helmet wearer 22) to extend in substantially the horizontal direction. In each of the intake/exhaust holes 43*a* and 43*b*, one half close the center of the front surface of the outer shell 31 serves as an intake hole portion, and the other half close to the outer side serves as an exhaust hole portion. A shutter member 44 is operated to reciprocally move in substantially the horizontal direction, so that it sets the intake hole portions of the intake/exhaust holes 43*a* and 43*b* in the open state (i.e., a state wherein the outer air can flow into the space in the head protecting body 21 through the intake hole portions of the intake/exhaust holes 43*a* and 43*b*) or in the closed state (i.e., a state wherein the outer air cannot flow into the space in the head protecting body 21 through the intake hole portions of the intake/exhaust holes 43*a* and 43*b*).

Referring to FIGS. 8 to 11, an intake opening 45 allows the outer air flowing into the outer shell 31 from the intake hole portions of the intake/exhaust holes 43*a* and 43*b* through an intake path 46 to flow upward toward the inner surface of the shield plate 24. The shutter member 44 opens/closes the intake opening 45. Intake path forming members 47 and 48 form the intake path 46 between the outer shell 31 and impact-on-the-chin-and-cheek absorbing liner 41. A breath guard 49 is conventionally known. The breath guard 49 is attached to the head protecting body 21 as it is sandwiched between the outer surface (i.e., the front surface) of the impact-on-the-chin-and-cheek absorbing liner 41 and the inner surfaces (i.e., the rear surfaces) of the outer shell 31 and intake path forming members 47 and 48.

As shown in FIGS. 9 and 10, the backing member 35 for the head has at least two air paths 51 for the head extending substantially semicircularly along the backing member 35 for the head from a portion near the front end to a portion near the rear end. An air inlet port 52 is formed at the starting end of each air path 51 for the head. The air inlet port 52 is open to near the upper end of the inner surface of the shield plate 24. An air outlet port 53 is formed at the terminal end of each air path 51 for the head. The air outlet port 53 is open to substantially near the lower end of substantially the central portion, in the right-to-left direction, of the occipital region opposing the occiput of the helmet wearer 22.

Referring to FIGS. 8 and 10, a pair of right and left shutter members 54 for the forehead ventilators are provided to the forehead region of the outer shell 31. When the shutter members 54 are reciprocally slid in their longitudinal direction, they can open and close the intake holes of the forehead ventilators. A pair of right and left shutter members 55 for the occiput are provided to the occipital region of the outer shell 31. When the shutter members 55 are reciprocally slid in their longitudinal direction, they can open and close the exhaust holes of the occipital ventilators.

The outer air (i.e., air) moving upward from the intake opening 45 along the inner surface of the shield plate 24 flows into the air paths 51 for the head near the upper end of the shield plate 24 through the air inlet ports 52, moves in the air paths 51 for the head to the air outlet ports 53, and is discharged outside from the air outlet ports 53. If the shutter members 54 open the intake holes of the forehead ventilators, the outer air flows from the intake holes into the air paths 51 for the head. If the shutter members 55 open the exhaust holes of the occipital ventilators, air in the air paths 51 partially flows to the outside from the exhaust holes.

The chin cover 1 comprised of the elastic shape retaining member 2 and flexible cover member 3 is attached to the chin cover portion 21a of the head protecting body 21 of the full-face-type helmet 20 shown in FIGS. 8 to 11.

(3) Description on How to Attach Chin Cover to Helmet

The chin cover 1 shown in FIGS. 1 and 2 can be attached to the head protecting body 21 of the full-face-type helmet 20 as shown in FIGS. 8 to 11 in accordance with the following procedure.

First, the elastic shape retaining member 2 of the chin cover 1 is stretched to decrease its bend in substantially its horizontal direction to the state shown in FIGS. 3 to 6.

Figure 11:
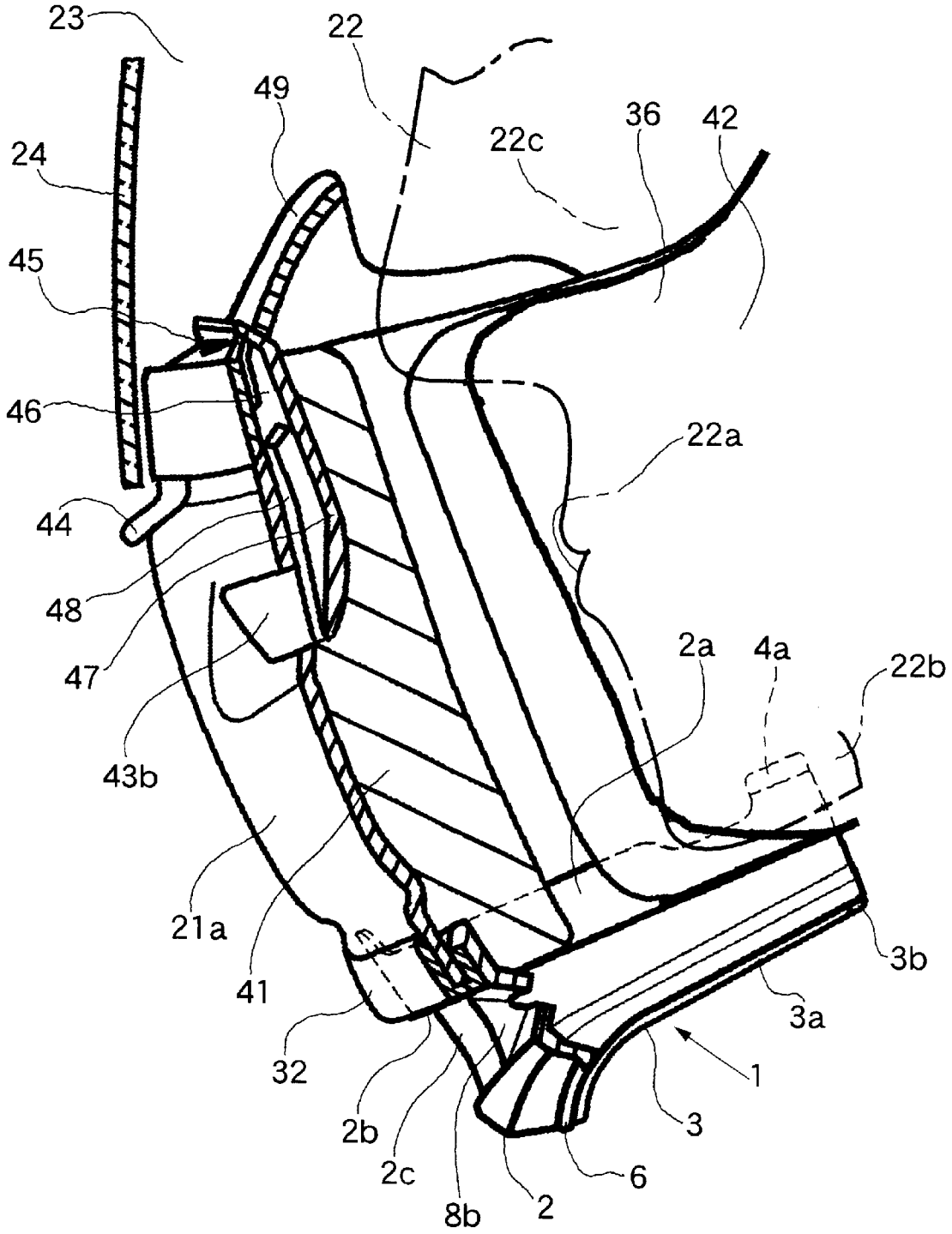
FIG. 11 is a partial enlarged view of the full-face-type helmet shown in FIG. 10.

The attached portion 2*a* of the elastic shape retaining member 2 is inserted between the outer shell 31 and impact-on-the-chin-and-cheek absorbing liner 41 (more specifically, between the inner surface of the lower rim member 32 and the outer surface of the impact-on-the-chin-and-cheek absorbing liner 41) from its upper end. This inserting operation is performed until the step 2*b* of the elastic shape retaining member 2 abuts against the lower end of the outer surface of the impact-on-the-chin-and-cheek absorbing liner 41 and is positionally regulated by it, as shown in FIG. 11. In this state, the attached portion 2*a* is pressed between the inner surface of the lower rim member 32 and the outer surface of the impact-on-the-chin-and-cheek absorbing liner 41, and the pair of right and left engaging pawls 4*a* and 4*b* and three locking steps 5*a*, 5*b* and 5*c* are locked by the upper end of the inner surface of the lower rim member 32 and the like, so that the elastic shape retaining member 2 and accordingly the chin cover 1 are attached to the head protecting body 21 such that they will not drop from it easily.

To remove the chin cover 1 from the head protecting body 21, the wind shield portion 2*c* and the like may be strongly pulled downward. In this case, the engaging pawls 4*a* and 4*b*, and locking steps 5*a*, 5*b* and 5*c* are unlocked from the upper end of the inner surface of the lower rim member 32 and the like, so that the attached portion 2*a* can be pulled out from the head protecting body 21.

When the chin cover 1 is attached to the head protecting body 21 of the full-face-type helmet 20, the wind shield portion 2*c* extends downward from the lower end of the head protecting body 21. Accordingly, the wind shield portion 2*c* covers the chin 22*b* of the helmet wearer 22 from its lower front, as shown in FIGS. 9 and 11. The flexible cover member 3 covers a portion of the chin 22*b* ranging from its lower front to a portion under it.

In the above state, when the helmet wearer 22 drives the motorcycle, the wind generated by driving to blow toward near the lower portion of the chin 22*b* abuts against the outer surface of the wind shield portion 2*c* and flows relatively backward along the outer surface of the wind shield portion 2*c*, thus being regulated by the wind shield portion 2*c*. The inner side of the wind shield portion 2*c* is thus set at a negative pressure, so the ventilation holes 7, 8*a* and 8*b* serve as exhaust holes. As a result, air in the lower front of the chin 22*b* flows into the ventilation holes 7, 8*a* and 8*b* through the backward openings 12 and is discharged to the outside from the forward openings 11, so that ventilation near the chin 22*b* is performed well. At the same time, the driving wind abutting against the chest of the helmet wearer 22 and directed toward the chin 22*b* is blocked by the flexible cover member 3 to a certain degree. Therefore, the driving wind is prevented from being dragged between the lower end of the chin cover portion 21a of the head protecting body 21 and the chin 22*b* of the helmet wearer 22 to produce a whistling sound.

The flexible cover member 3 is preferably made of a nonpermeable fabric material if considering only its effect of preventing the driving wind from being dragged between the lower end of the chin cover portion 21*a* of the head protecting body 21 and the chin 22*b* of the helmet wearer 22 to produce a whistling sound, but is preferably made of mainly an air permeable fabric material such as a lace fabric if considering both its effect of prevention of the whistling sound and its anti-fogging effect for the shield plate 24.

Having described a specific preferred embodiment of this invention with reference to the accompanying drawings, it is to be understood that the invention is not limited to the precise embodiment, and that various changes and modifications may be effected therein by one skilled in the art without departing from the scope or spirit of the invention as defined in the appended claims.

For example, although the chin cover 1 is attached to the full-face-type helmet 20 in the above embodiment, it may be attached to a full-face-type helmet serving also as a jet-type helmet the chin cover portion of which can be lifted. In this case, if necessary, a flexible cover member 3 may be omitted from a chin cover 1, or the shape of the flexible cover member 3 may be changed.

Although three ventilation holes 7, 8*a* and 8*b* are formed in the above embodiment to be lined up substantially horizontally, the number and positions of the ventilation holes can be changed arbitrarily if necessary.

Although all of the ventilation holes 7, 8*a* and 8*b* serve as exhaust holes in the above embodiment, if necessary, at least one of the ventilation holes may serve as an exhaust hole and ventilation holes not serving as exhaust holes may serve as intake holes.

What is claimed is:

1. A helmet chin cover comprising a shape retaining member having an attached portion which can be attached to a helmet, and a wind shield portion capable of preventing a driving wind from abutting against a chin of a helmet wearer when said attached portion is attached to said helmet, said wind shield portion having at least one ventilation hole;

a flexible cover member spreading backward in a substantially horizontal direction is attached to near a lower end of said wind shield portion;

wherein said shape retaining member is elastic, has a central portion projecting forward, extends in a substantially horizontal direction to be bent in a substantially arcuate manner, and is upright in a substantially vertical direction, and said shape retaining member is monolithically molded from an elastic material.

2. A chin cover according to claim 1, wherein said flexible cover member is mainly made of an air permeable fabric material.

3. A chin cover according to claim 1, wherein said flexible cover member substantially has the shape of a crescent.

4. A chin cover according to claim 1, wherein said attached portion is formed at an upper portion of said shape retaining member along a substantially longitudinal direction thereof, and said wind shield portion is continuously formed below said attached portion through a position regulating step.

5. A chin cover according to claim 4, wherein said wind shield portion is continuously formed at a lower end of said attached portion through said position regulating step.

6. A chin cover according to claim 1, wherein said ventilation hole includes one at substantially the center of said wind shield portion and one on each of right and left sides of said wind shield portion, leading to a total of three.

7. A chin cover according to claim 1, wherein said ventilation hole has a tubular projecting portion projecting backward from said wind shield portion to substantially form a frustum of a cone, said tubular projecting portion having forward and backward openings, said tubular projecting portion having an opening area which increases gradually from said backward opening toward said forward opening.

8. A chin cover according to claim 7, including at least one other ventilation hole serving as an exhaust hole.

9. A chin cover according to claim 7, wherein said backward opening is inclined upward with respect to said forward opening with a relative inclination angle falling within a range of 25° to 65°.

10. A chin cover according to claim 9, wherein the inclination angle falls within a range of 35° to 55°.

11. A chin cover according to claim 7, wherein the area ratio of said forward opening to said backward opening falls within a range of 1.5 to 4.

12. A chin cover according to claim 11, wherein the area ratio falls within a range of 2 to 3.5.

13. A chin cover according to claim 7, wherein the opening area of said backward opening falls within a range of 0.5 $cm^2$ to 2 $cm^2$.

14. A chin cover according to claim 13, wherein the opening area of said backward opening falls within,a range of 0.8 $cm^2$ to 1.6 $cm^2$.

15. A chin cover according to claim 7, wherein said wind shield portion has said central portion with a height falling within a range of 1.5 cm to 3.5 cm.

16. A chin cover according to claim 15, wherein the height of said central portion falls within a range of 2 cm to 3 cm.

17. A chin cover according to claim 7, wherein said wind shield portion is formed such that a height thereof gradually decreases from a central portion of said wind shield portion toward right and left ends thereof, the ratio of the height of said right and left ends to the height of said central portion of said wind shield portion falls within a range of ¼ to ¾.

18. A chin cover according to claim 17, wherein the ratio in height falls within a range of ⅓ to ⅔.

19. A chin cover according to claim 17, wherein said wind shield portion has a length falling within a range of 18 cm to 32 cm in a horizontal direction along a front surface thereof.

20. A chin cover according to claim 19, wherein the length in the horizontal direction falls within a range of 21 cm to 29 cm.

21. A chin cover according to claim 1, wherein said attached portion has at least one engaging pawl and/or at least one engaging step.

22. A chin cover comprising a shape retaining member having an attached portion which can be attached to a helmet and a wind shield portion capable of preventing a driving wind from abutting against a chin of a helmet wearer when said attached portion is attached to said helmet, wherein said wind shield portion has at least one ventilation hole serving as an exhaust hole, said shape retaining member is elastic, has a central portion projecting forward, extends in a substantially horizontal direction to be bent in a substantially arcuate manner, and is upright in a substantially vertical direction, said attached portion is formed at an upper portion of said shape retaining member along a substantially longitudinal direction thereof, said wind shield portion is continuously formed below said attached portion, said ventilation hole has a tubular projecting portion projecting backward from said wind shield portion to substantially form a frustum of cone, said tubular projecting portion has forward and backward openings, said shape retaining member is monolithically molded from an elastic material, and a flexible cover member spreading backward in a substantially horizontal direction is attached to near a lower end of said wind shield portion.

23. A chin cover according to claim 22, wherein said wind shield portion is continuously formed below said attached portion through a position regulating step.

24. A helmet comprising a head protecting body attached to a chin cover, said chin cover including:

(1) a shape retaining member having an attached portion structured and dimensioned to enable said chin cover to be attached to said head protecting body, (2) a wind shield portion capable of preventing a driving wind from abutting against a region near a chin of a helmet wearer when said attached portion of said chin cover is attached to said head protecting body of said helmet, said wind shield portion having at least one ventilation hole formed therein, (3) a flexible cover member spreading backward in a substantially horizontal direction is attached to near a lower end of said wind shield portion, (4) wherein said shape retaining member is elastic, has a central portion projecting forward, extends in a substantially horizontal direction to be bent in a substantially arcuate manner, and is upright in a substantially vertical direction, and (5) said shape retaining member is monolithically molded from an elastic material.

25. A helmet according to claim 24, wherein said head protecting body has an outer shell and an impact absorbing liner disposed in said outer shell, and said attached portion of said chin cover is inserted between said outer shell and said impact absorbing liner so that said chin cover is attached to said head protecting body.

26. A helmet according to claim 24, wherein said head protecting body has an outer shell and an impact absorbing liner disposed in said outer shell, and said attached portion of said cover is inserted between said outer shell and said impact absorbing liner and a position regulating step of said shape retaining member is positionally regulated at a lower end of said impact absorbing liner, so that said chin cover is attached to said head protecting body.

27. A helmet according to claim 24, wherein said head protecting body has an outer shell, a rim member attached to a lower end of said outer shell, and an impact absorbing member disposed in said outer shell, and said attached portion of said chin cover is inserted between said outer shell and said impact absorbing liner and at least one engaging pawl and/or at least one engaging step of said attached portion is locked by said rim member, so that said chin cover is attached to said head protecting body.

* * * * *